US011657745B2

(12) United States Patent
Baek et al.

(10) Patent No.: US 11,657,745 B2
(45) Date of Patent: May 23, 2023

(54) CURVED AND FLAT COMBINED DISPLAY DEVICE AND METHOD FOR OPERATING THE SAME

(71) Applicant: LG DISPLAY CO., LTD., Seoul (KR)

(72) Inventors: Seungmin Baek, Seoul (KR); Seungsoo Choi, Paju-si (KR); Sanghoon Park, Incheon (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/550,434

(22) Filed: Dec. 14, 2021

(65) Prior Publication Data

US 2022/0208048 A1 Jun. 30, 2022

(30) Foreign Application Priority Data

Dec. 30, 2020 (KR) ..... 10-2020-0188319

(51) Int. Cl.
*G09G 3/00* (2006.01)
*G09G 3/3208* (2016.01)

(52) U.S. Cl.
CPC ..... *G09G 3/03* (2020.08); *G09G 3/3208* (2013.01); *G09G 2320/0233* (2013.01); *G09G 2360/16* (2013.01)

(58) Field of Classification Search
CPC ..... G09G 3/03; G09G 3/3208; G09G 2320/0233; G09G 2360/16; G09G 5/363; G09G 3/3611; G09G 3/20; G09G 3/3648; G09G 3/006; G09G 5/00; G09G 3/035; G09G 5/10; G06F 1/00; G06F 3/013; H04N 5/57; H05K 5/0017; G06T 15/50; G09F 9/301
See application file for complete search history.

(56) References Cited

U.S. PATENT DOCUMENTS

2008/0062164 A1* 3/2008 Bassi ..... H04N 9/3147 345/214
2012/0235893 A1* 9/2012 Phillips ..... G06F 3/013 345/204
2013/0201180 A1* 8/2013 Jeon ..... G09G 3/3648 345/419
2013/0321740 A1* 12/2013 An ..... H05K 5/0017 361/679.01

(Continued)

FOREIGN PATENT DOCUMENTS

KR 10-2015-0048967 A 5/2015
KR 10-2016-0016214 A 2/2016

(Continued)

*Primary Examiner* — Richard J Hong
(74) *Attorney, Agent, or Firm* — Polsinelli PC

(57) ABSTRACT

A curved and flat combined display device includes a display panel having a flat area and a curved area, a compensation value generator configured to compare curved area data of an image data input from an external system with curved area data of imaged data generated by capturing the display panel, and generate compensation value data for the curved area of the display panel, based on the comparing result, and a controller configured to compensate for the curved area data of the image data input from the external system based on the compensation value data, and control the display panel to display the compensated curved area data of the image data.

20 Claims, 4 Drawing Sheets

(56) References Cited

U.S. PATENT DOCUMENTS

| | | | | |
|---|---|---|---|---|
| 2014/0118319 | A1* | 5/2014 | Jeon | G06F 1/00 345/207 |
| 2014/0306985 | A1* | 10/2014 | Jeong | G09G 3/035 345/600 |
| 2015/0116384 | A1 | 4/2015 | Kim et al. | |
| 2015/0130775 | A1* | 5/2015 | Kim | G09F 9/301 345/82 |
| 2016/0027364 | A1* | 1/2016 | Park | G09G 3/03 345/690 |
| 2016/0117994 | A1* | 4/2016 | Lee | H04N 5/57 345/694 |
| 2016/0196778 | A1* | 7/2016 | Cha | G09G 3/03 345/694 |
| 2017/0206859 | A1* | 7/2017 | Jun | G09G 3/006 |
| 2018/0122284 | A1* | 5/2018 | Zhang | G09G 3/3611 |
| 2018/0226012 | A1* | 8/2018 | Sim | G09G 5/363 |
| 2019/0080671 | A1* | 3/2019 | Jun | G09G 5/10 |
| 2019/0121390 | A1* | 4/2019 | Yang | G09G 3/3208 |
| 2019/0340983 | A1* | 11/2019 | Son | G06T 15/50 |
| 2020/0193898 | A1* | 6/2020 | Wang | G09G 3/20 |
| 2020/0294469 | A1* | 9/2020 | Kim | G09G 5/00 |

FOREIGN PATENT DOCUMENTS

| | | | |
|---|---|---|---|
| KR | 10-2018-0061792 | A | 6/2018 |
| KR | 10-2019-0035629 | A | 4/2019 |

* cited by examiner

CURVED AND FLAT COMBINED DISPLAY DEVICE AND METHOD FOR OPERATING THE SAME

CROSS-REFERENCE TO RELATED APPLICATION

This application claims the priority of Korean Patent Application No. 10-2020-0188319 filed on Dec. 30, 2020, which is hereby incorporated by reference in its entirety for all purposes.

BACKGROUND

Field of the Disclosure

The present disclosure relates to a curved and flat combined display device, and more specifically, a curved and flat combined display device capable of improving image display quality and reliability by preventing an image of a curved area from being distorted, and a method for operating the same.

Description of the Background

A flat image display device that displays various information on a screen is a key technology in the information communication era, and is developing toward a thinner, lighter, portable and high-performance device.

Specific examples of the flat image display device include a liquid crystal display device (LCD), a quantum dot display device (QD), a field emission organic light-emitting display device (FED), and an organic light-emitting display device (OLED).

Among the flat image display devices as listed above, the organic light-emitting display device (OLED) has high luminance, low operation voltage, and may be embodied as an ultra-thin film, and thus is usefully applied to mobile communication devices such as smartphones and tablet pads.

Recently, it is easy to apply an organic light-emitting display device using a self-luminous device as a curved and flat combined display device. Thus, the organic light-emitting display device is mainly developed and commercialized as the curved and flat combined display device.

Therefore, unlike the general flat display device, in the curved and flat combined display device, compensation techniques for preventing display luminance in the curved area from being outputted in a distorted state or preventing a stain in the curved area from being recognized are additionally should be applied and developed.

The curved and flat combined display device has a larger viewing angle change in a curved area, unlike a general flat display device. Thus, as the viewing angle changes, a color characteristic rendered in the curved area is distorted.

SUMMARY

Accordingly, the present disclosure is to provide a curved and flat combined display device and a method for operating the same, in which an image of the curved area is corrected based on a distortion state of the curved area detected via an imaging camera, such that the image of the curved area is not recognized in a distorted state.

More specifically, the present disclosure is to provide a curved and flat combined display device and a method for operating the same, in which an image of the curved area is corrected based on a distortion state thereof detected via the imaging camera when inspecting a display panel, and a compensation data therefor, such that luminance distortion of the curved area is suppressed while a stain is not displayed.

The present disclosure is not limited to the above-mentioned purpose. Advantages according to the present disclosure that are not mentioned may be understood based on following descriptions, and may be more clearly understood based on aspects according to the present disclosure. Further, it will be easily understood that the purposes and advantages according to the present disclosure may be realized using means shown in the claims and combinations thereof.

In a curved and flat combined display device according to an aspect of the present disclosure, a flat area and a curved area are divided from each other, and an image is displayed without luminance distortion on a display panel that displays an image using pixels arranged in the flat area and the curved area. To this end, the device includes a compensation value generator to compare curved area data of image data input from an external system with curved area data of imaged data generated by capturing the display panel, and to generate compensation value data for the curved area of the display panel, based on the comparing result. Further, the device includes a controller that compensates for the curved area data of the image data input from the external system using the compensation value data and allows compensated curved area data of the image data to be displayed on the display panel.

The controller adds or subtracts the compensation value data to or from the curved area data of the image data input from the external system or multiplies the curved area data by the compensation value data to generate the compensated image data in which the curved area is corrected, and allows the compensated image data to be displayed on the display panel.

Further, a method for operating a curved and flat combined display device according to an aspect of the present disclosure includes dividing image data input from an external system into curved area data and flat area data, calculating luminance compensation data from the curved area data, dividing imaged data captured by an imaging camera into curved area data and flat area data, and calculating stain compensation data from the curved area data of the imaged data.

Further, the method further includes comparing the luminance compensation data with the stain compensation data, generating compensation value data for the curved area of the display panel, based on the comparison result, compensating for the curved area data of the image data input from the external system using the compensation value data, and allowing the compensated curved area data of the image data to be displayed on the display panel.

In the curved and flat combined display device according to aspects of the present disclosure, the image data of the curved area is corrected based on the distortion information for the curved area as detected via the imaging camera, and the compensation data therefor, and then the corrected image data of the curved area is displayed, thereby increasing the luminance distortion correction effect of the curved area and thus improving the image quality.

Further, the image data of the curved area is corrected such that the luminance of the curved area is not recognized in a distorted state and the stain is not displayed on the curved area, thereby improving the image data correction satisfaction and reliability of the curved area.

Effects of the present disclosure are not limited to the above-mentioned effects, and other effects as not mentioned will be clearly understood by those skilled in the art from following descriptions.

BRIEF DESCRIPTION OF DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTIONS

Figure 1:
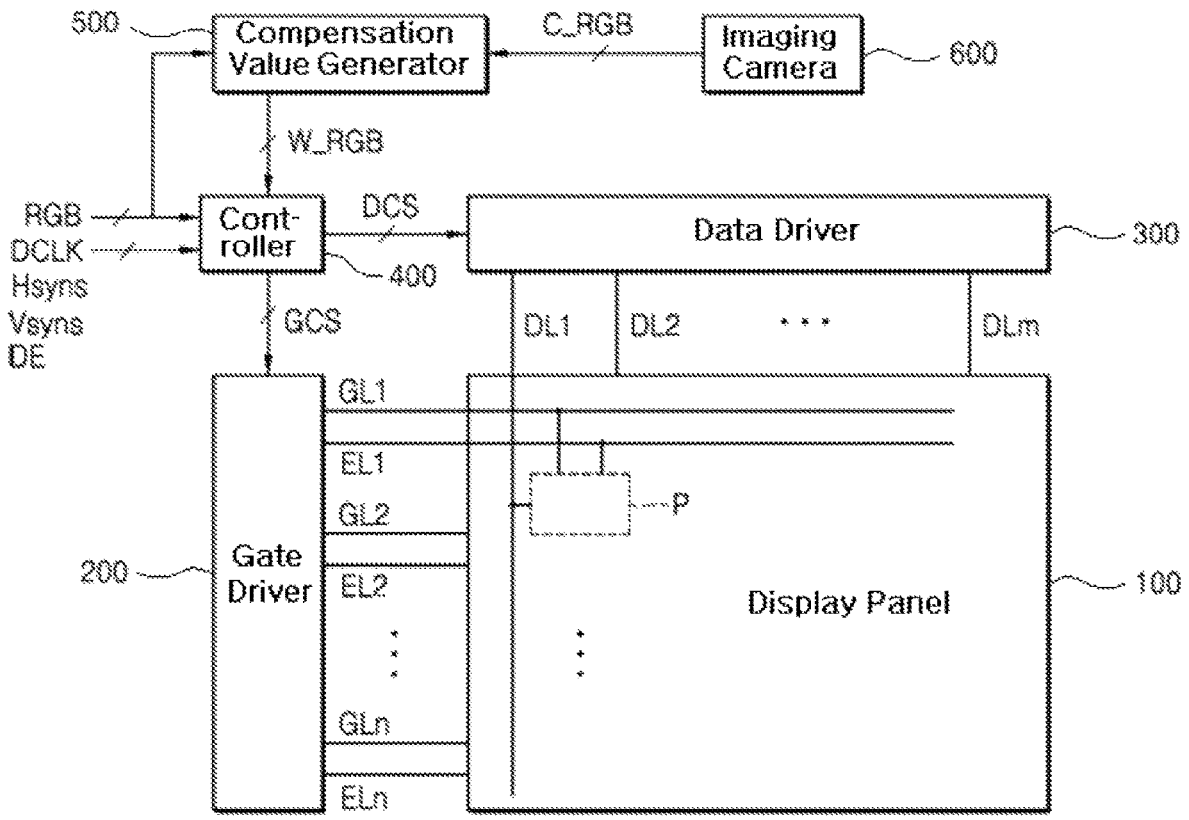
FIG. 1 is a block diagram schematically showing an organic light-emitting display device according to an aspect of the present disclosure.

For simplicity and clarity of illustration, elements in the drawings are not necessarily drawn to scale. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various aspects are illustrated and described further below. It will be understood that the description herein is not intended to limit the claims to the specific aspects described. On the contrary, it is intended to cover alternatives, modifications, and equivalents as may be included within the spirit and scope of the present disclosure as defined by the appended claims.

A shape, a size, a ratio, an angle, a number, etc. disclosed in the drawings for describing an aspects of the present disclosure are exemplary, and the present disclosure is not limited thereto. The same reference numerals refer to the same elements herein. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

The terminology used herein is for the purpose of describing particular aspects only and is not intended to limit the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entirety of list of elements and may not modify the individual elements of the list. When referring to "C to D", this means C inclusive to D inclusive unless otherwise specified.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

Further, as used herein, when a layer, film, region, plate, or the like is disposed "on" or "on a top" of another layer, film, region, plate, or the like, the former may directly contact the latter or still another layer, film, region, plate, or the like may be disposed between the former and the latter. As used herein, when a layer, film, region, plate, or the like is directly disposed "on" or "on a top" of another layer, film, region, plate, or the like, the former directly contacts the latter and still another layer, film, region, plate, or the like is not disposed between the former and the latter. Further, as used herein, when a layer, film, region, plate, or the like is disposed "below" or "under" another layer, film, region, plate, or the like, the former may directly contact the latter or still another layer, film, region, plate, or the like may be disposed between the former and the latter. As used herein, when a layer, film, region, plate, or the like is directly disposed "below" or "under" another layer, film, region, plate, or the like, the former directly contacts the latter and still another layer, film, region, plate, or the like is not disposed between the former and the latter.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In one example, when a certain aspect may be implemented differently, a function or operation specified in a specific block may occur in a sequence different from that specified in a flowchart. For example, two consecutive blocks may actually be executed at the same time. Depending on a related function or operation, the blocks may be executed in a reverse sequence.

In descriptions of temporal relationships, for example, temporal precedent relationships between two events such as "after", "subsequent to", "before", etc., another event may occur therebetween unless "directly after", "directly subsequent" or "directly before" is not indicated. The features of the various aspects of the present disclosure may be partially or entirely combined with each other, and may be technically associated with each other or operate with each other. The aspects may be implemented independently of each other and may be implemented together in an association relationship. Spatially relative terms, such as "beneath," "below," "lower," "under," "above," "upper," and the like, may be used herein for ease of explanation to describe one element or feature's relationship to another element or feature as illustrated in the figures. It will be understood that the spatially relative terms are intended to encompass different orientations of the device in use or in operation, in addition to the orientation depicted in the figures. For example, when the device in the drawings is turned over, elements described as "below" or "beneath" or "under" other elements or features would then be oriented "above" the other elements or features. Thus, the example terms "below" and "under" may encompass both an orientation of above and below. The device may be otherwise oriented for example, rotated 90 degrees or at other orientations, and the spatially relative descriptors used herein should be interpreted accordingly.

Hereinafter, a curved and flat combined display device according to an aspect of the present disclosure and a method for operating the same will be described in more detail with reference to the accompanying drawings.

An image display device that may be embodied as a curved and flat combined display device may include a field emission display device, a quantum dot display device, and an organic light-emitting display device. An example in which an organic light-emitting display device is embodied as the curved and flat combined display device will be described below. However, the disclosure is not limited thereto.

FIG. 1 is a block diagram schematically showing an organic light-emitting display device according to an aspect of the present disclosure.

Referring to FIG. 1, an organic light-emitting display device includes a display panel 100 including a plurality of pixels P, a gate driver 200, a data driver 300, a compensation value generator 500, and a controller 400.

The controller 400 may be configured to be combination with a microprocessor, a mobile processor, an application processor, and the like. Further, each of the gate driver 200, the data driver 300, and the compensation value generator 500 may be embodied as a microprocessor. Accordingly, the controller 400 may be integrated with at least one of the gate driver 200, the data driver 300, and the compensation value generator 500 to form a single chip. However, in the present disclosure, in order to clearly distinguish operations of the components from each other, an example in which each of the gate driver 200, the data driver 300, and the compensation value generator 500 is separate from the controller 400 will be described below. However, the disclosure is not limited thereto.

In the display panel 100, a plurality of gate lines GL1 to GLn and a plurality of light-emission control lines EL1 to ELn intersect a plurality of data lines DL1 to DLm. Each of the plurality of pixels P is connected to at least one gate line GL, at least one light-emission control line EL, and at least one data line DL and is disposed at an intersection area therebetween. Specifically, one pixel P receives a scan signal from the gate driver 300 via one gate line GL, receives a data signal from the data driver 300 via one data line DL, receives a light-emission control signal via one light-emission control line EL, and receives high-potential and low-potential powers respectively via separate power supply lines.

An inner area of a front face of the display panel 100 where an image is displayed is formed in a flat shape, while an outer area thereof is a curved area having a predefined curvature. In one example, the curved area having the predefined curvature may be formed on each of both opposing sides of the display panel 100 in a vertical and longitudinal direction thereof. However, the disclosure is not limited thereto.

In this connection, during imaging inspection of the display panel 100, a front face of the display panel 100 in an image display state is captured with an imaging camera 600. It may be detected that luminance and chrominance characteristics of the image displayed on the curved area on each of both sides of the display panel 100 are in a distorted state. In this connection, a stain may be detected due to the luminance and chrominance characteristics that are in the distorted state.

During the imaging inspection of the display panel 100, the controller 400 may align image data RGB supplied from a separate system or an auto probe unit based on characteristics of the display panel 100 without additional correction and supplies the aligned image data to the data driver 300.

However, in a commercialized state of the device, the controller 400 compensates for a portion of the image data RGB input from the external system and corresponding to the curved area of the display panel 100 and transmits the compensated image data to the data driver 300, such that the image of the curved area is not displayed in a distorted state.

In order to display the compensated image data RGB, the controller 400 generates gate and data control signals GCS and DCS using a dot clock CLK, a data enable signal DE, a horizontal synchronization signal Hsync, and a vertical synchronization signal Vsync as input from an external system, and control the gate and data drivers 200 and 300, based on the generated gate and data control signals GCS and DCS.

The compensation value generator 500 receives the same image data RGB provided to the controller 400 when inspecting the display panel 100. In addition, the compensation value generator 500 receives imaged data C_RGB of the display panel 100 as captured by the imaging camera 600 and stores therein the imaged data C_RGB.

The controller 400 divides the image data RGB input from the external system into curved area data and flat area data, and the compensation value generator 500 corrects the curved area data using the flat area data corresponding to at least one horizontal line to calculate luminance compensation data for the curved area. In this case, the luminance compensation data may be calculated by correcting the curved area data based on a gray level value or a luminance value for image display.

Further, the controller 400 divides the imaged data C_RGB into flat area data and curved area data and then the compensation value generator 500 corrects the curved area data of the imaged data C_RGB based on the flat area data thereof to calculate stain compensation data for the curved area. In this case, the stain compensation data may be calculated by correcting the curved area data, based on a gray level value or a luminance value of the imaged data C_RGB where a stain is detected.

The compensation value generator 500 may compare the luminance compensation data calculated based on the image data RGB and the stain compensation data calculated based on the imaged data C_RGB with each other and generate the compensation value data for the curved area of the display panel 100, based on the comparing result. Moreover, the compensation value generator 500 may send the compensation value data to the controller 400. In the commercialized state of the device after the inspection, the controller 400 may control the display panel to display the image data RGB input from the external system as compensated image data compensated based on the compensation value data.

In other words, when the image data RGB from the external system is input to the device in the commercialized state of the display device, the controller 400 divides the image data RGB into the flat area data corresponding to the flat are and the curved area data corresponding to the curved area and adds or subtracts the compensation value data to or from the curved area data, or multiplies the curved area data by the compensation value data, thereby generating compensated image data W_RGB in which the curved area data is in a compensated state. Moreover, the controller 4000 rearranges the compensated image data W_RGB based on the display characteristics of the display panel 100 and supplies the rearranged compensated image data W_RGB to the data driver 300.

The gate driver 200 sequentially supplies a scan signal as a gate signal to each of the gate lines GL1 to GLn according to the gate control signal GCS supplied from the controller 400.

As described above, FIG. 1 shows an example in which the gate driver 200 is disposed separately from the controller 400 to distinguish functions and operations therebetween. In another example, the gate driver 200 may be formed integrally with the controller 400.

The data driver 300 converts the compensated image data W_RGB into a data voltage in response to reception of the data control signal DCS supplied from the controller 400, and supplies the converted data voltage to each of data lines DL1 to DLm. Similarly, although an example in which the data driver 300 is disposed separately from the controller 400 is shown in FIG. 1 to distinguish functions and operations therebetween, the data driver 300 may be formed integrally with the controller 400.

Figure 2:
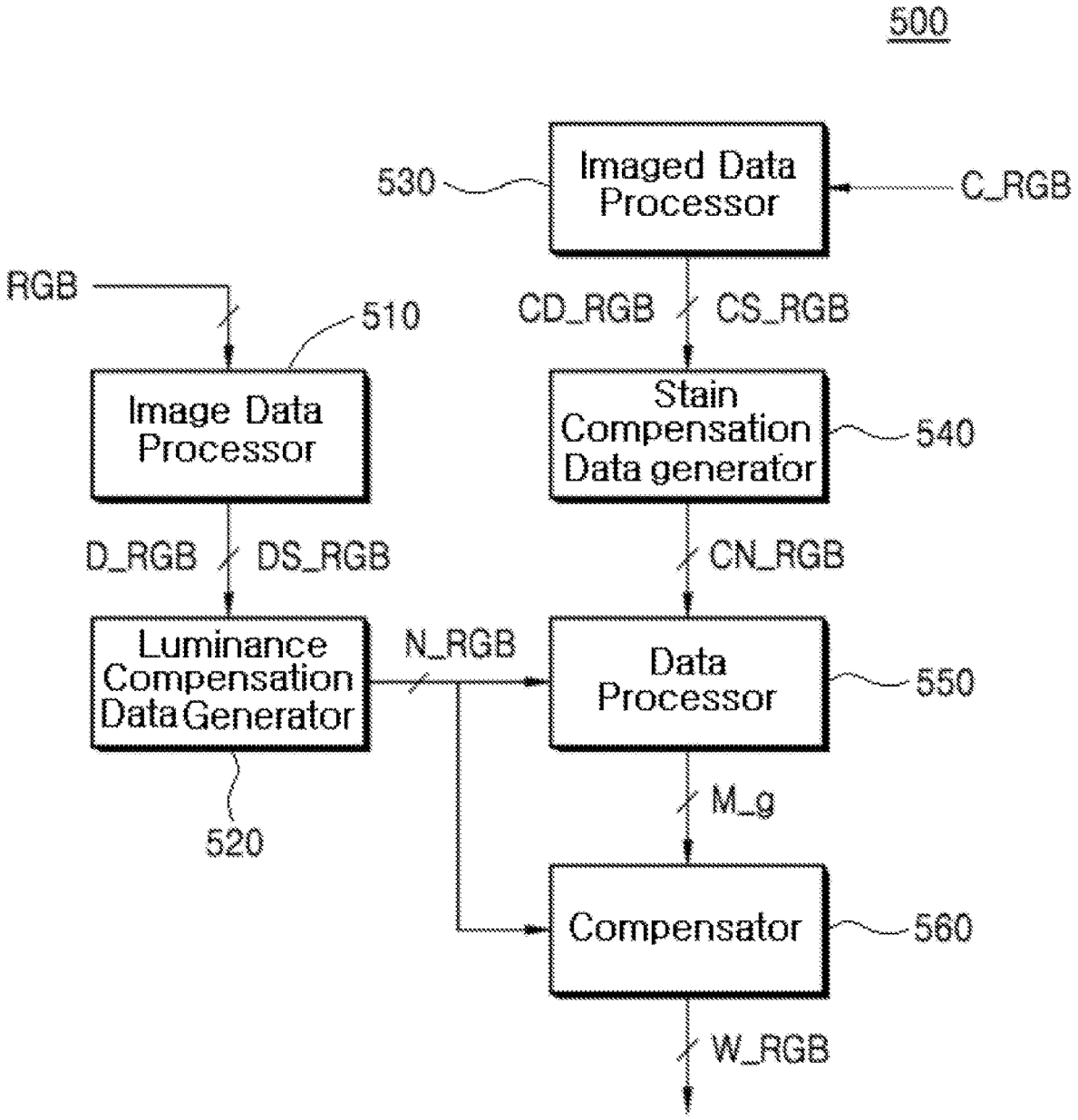
FIG. 2 is a block diagram showing a compensation value generator shown in FIG. 1 in detail.

FIG. 2 is a block diagram showing a compensation value generator shown in FIG. 1 in detail.

The compensation value generator 500 shown in FIG. 2 includes an image data processor 510, a luminance compensation data generator 520, an imaged data processor 530, a stain compensation data generator 540, a data processor 550, and a compensator 560.

The image data processor 510 receives the same image data RGB provided to the controller 400 from a separate inspection system or auto probe unit during the imaging inspection of the display panel 100. Moreover, the image data processor 510 divides the image data RGB into curved area data DS_RGB and flat area data D_RGB based on predefined pixel arrangement information of the curved area, for example, resolution information of the curved area, and stores therein the area data DS_RGB and the flat area data D_RGB.

The luminance compensation data generator 520 corrects the curved area data DS_RGB from the image data processor 510 based on a luminance value or a gray level value of the flat area data D_RGB, thereby to calculate luminance compensation data N_RGB for the curved area data DS_RGB. In this case, luminance compensation may be achieved because the curved area data is corrected based on the gray level value or the luminance value for image display. However, a stain compensation effect is inevitably insignificant because the stain is not identified.

Figure 3:
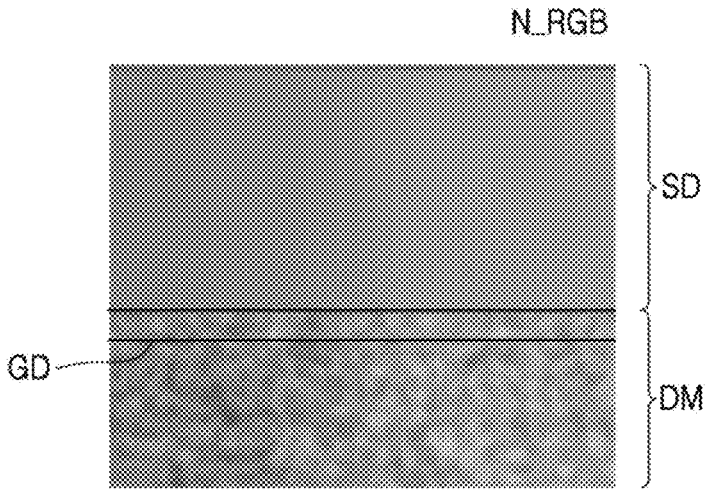
FIG. 3 is an image diagram to illustrate the luminance compensation data generation method of the luminance compensation data generator shown in FIG. 2.

FIG. 3 is an image diagram to illustrate a luminance compensation data generation method using the luminance compensation data generator shown in FIG. 2.

Referring to FIG. 3, the luminance compensation data generator 520 replaces the curved area data DS_RGB from the image data processor 510 with flat area data GD corresponding to at least one horizontal line of a portion of a flat area disposed adjacent to the curved area SD, thereby correcting the curved area data DS_RGB. Moreover, the luminance compensation data generator 520 compares a pixel-based gray level value or luminance value of the correct curved area data with a pixel-based gray level value or luminance value of the curved area data DS_RGB from the image data processor 510 and calculates luminance compensation data N_RGB based on a difference value therebetween.

In one example, the imaged data processor 530 receives and stores imaged data C_RGB of the display panel 100 captured via the imaging camera 600 during the imaging inspection of the display panel 100. Moreover, the imaged data processor 530 divides the imaged data C_RGB into curved area data CS_RGB and flat area data CD_RGB, based on predefined pixel arrangement information of the curved area, for example, based on the resolution information of the curved area, and stores therein the curved area data CS_RGB and the flat area data CD_RGB.

The stain compensation data generator 540 corrects the curved area data CS_RGB of the imaged data C_RGB based on a luminance value or a gray level value of the flat area data CD_RGB, thereby to calculate stain compensation data CN_RGB for the curved area.

A stain displayed on the curved area of the display panel 100 may be detected using the imaging camera 600. Thus, the stain compensation data CN_RGB may be calculated by correcting the curved area data CS_RGB based on the gray level value or luminance value of the flat area data CD_RGB of the imaged data C_RGB.

Figure 4:
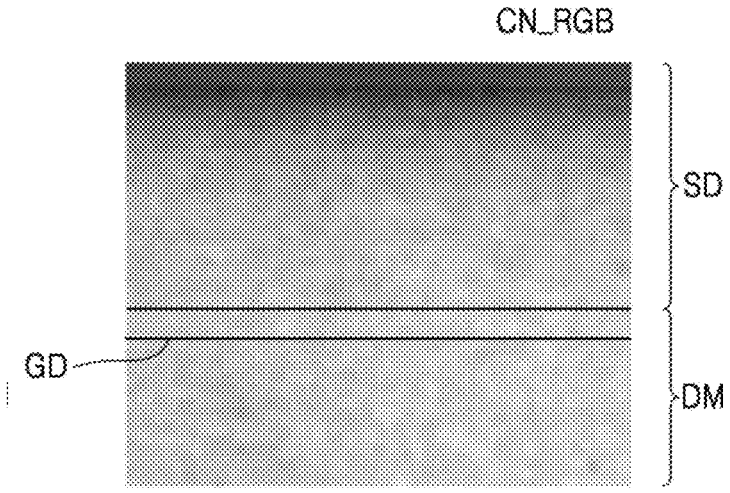
FIG. 4 is an image diagram to illustrate a stain compensation data generation method using a stain compensation data generator shown in FIG. 2.

FIG. 4 is an image diagram to illustrate the stain compensation data generation method using the stain compensation data generator shown in FIG. 2.

Referring to FIG. 4, the stain compensation data generator 540 may replace the curved area data CS_RGB of the imaged data C_RGB from the imaged data processor 530 with flat area data corresponding to at least one horizontal line of a portion of a flat area disposed adjacent to the curved area SD, thereby correcting the curved area data CS_RGB of the imaged data C_RGB. Moreover, stain compensation data generator 540 may compare a pixel-based gray level value or luminance value of the corrected curved area data with a pixel-based gray level value or luminance value of the curved area data CS_RGB from the imaged data processor 530, and then calculate the stain compensation data CN_RGB based on a difference value therebetween.

The data processor 550 compares the luminance compensation data N_RGB for the curved area of the image data RGB with the stain compensation data CN_RGB for the curved area of the image data C_RGB, and calculates compensation value data M_g for the curved area based on the comparing result.

Specifically, the data processor 550 may generate the compensation value data M_g as a result value obtained by dividing the stain compensation data CN_RGB by the luminance compensation data N_RGB. In one example, the data processor 550 may generate the compensation value data M_g as a result value obtained by dividing a pixel-based gray level value or luminance value of the stain compensation data CN_RGB by a pixel-based gray level value or luminance value of the luminance compensation data N_RGB that matches the resolution of the curved area.

The data processor 550 may share the compensation value data with the controller 400. Thus, in the compensation operation of the controller 400, the controller may compensate for the externally input image data RGB based on the compensation value data M_g. Then, the controller 400 may control the display panel to display the compensated image data.

In one example, the compensator 560 may compensate for the input image data RGB based on the compensation value data M_g and then supply the compensated image data W_RGB to the controller 400.

Figure 5:
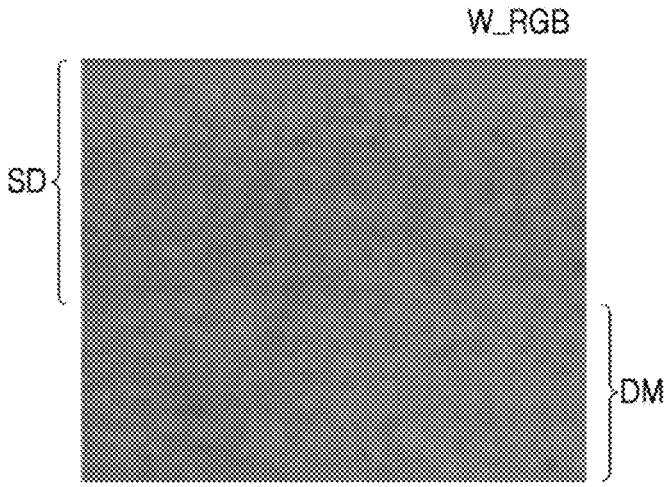
FIG. 5 is an image diagram to illustrate a compensation value data generation and application method using a data processor shown in FIG. 2.

FIG. 5 is an image diagram showing a result of compensation value data application and image data compensation using the compensator shown in FIG. 2.

Referring to FIG. 5, the compensator 560 reads and stores therein the compensation value data M_g from the data processor 550. Moreover, as shown in FIG. 5, when the image data RGB for image display is input to the compensator 560 from the external system, the compensator 560 may add or subtract the compensation value data M_g to or from the curved area data of the image data RGB, or multiply the curved area data by the compensation value data M_g, thereby to generate the compensated image data W_RGB in which the curved area is in a compensated state. In this case, the controller 400 may rearrange the compensated image data W_RGB from the compensator 560 based on the display characteristic of the display panel 100, and supply the rearranged compensated image data W_RGB to the data driver 300.

Figure 6:
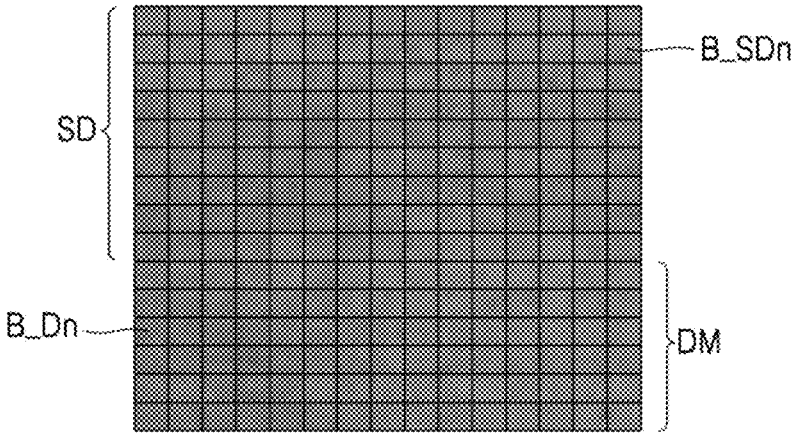
FIG. 6 is another image diagram to illustrate a compensation value data generation and application method using a compensation value generator shown in FIG. 2.

FIG. 6 is another image diagram for illustrating a compensation value data generation and application method using the compensation value generator shown in FIG. 2.

Referring to FIG. 6, the luminance compensation data generator 520 replaces the curved area data DS_RGB from the image data processor 510 with flat area data B_SDn corresponding to at least one block area of a portion of a flat area adjacent to the curved area SD, thereby compensating for the curved area data DS_RGB. The block area may be preset to a N×M size. In this connection, each of N and M may be a natural number greater than or equal to 2. Moreover, the luminance compensation data generator 520 may use the compensated curved area data to generate luminance compensation data N_RGB and supply the generated luminance compensation data N_RGB to the data processor 550.

In one example, the stain compensation data generator 540 also replaces the curved area data CS_RGB of the imaged data C_RGB from the imaged data processor 530 with flat area data B_SDn corresponding to at least one block area of a portion of an flat area adjacent to curved area SD, thereby compensate for the curved area data CS_RGB of the imaged data C_RGB. The block area may be preset to a N×M size. In this connection, each of N and M may be a natural number greater than or equal to 2. Moreover, the stain compensation data generator 540 may use the compensated curved area data to generate stain compensation data CN_RGB and supply the generated stain compensation data CN_RGB to the data processor 550.

Therefore, as described above, the data processor 550 may generate the compensation value data M_g based on the luminance compensation data N_RGB for the curved area of the image data RGB and the stain compensation data CN_RGB for the curved area of the image data C_RGB.

Further, the data processor 550 may share the compensation value data M_g with the controller 400. Thus, according to the compensation operation of the controller 400, the externally input image data RGB may be compensated for based on the compensation value data M_g. Then, the controller may control the display panel to display the compensated image data.

As described above, in the curved and flat combined display device according to aspects of the present disclosure, the image data of the curved area is corrected based on the distortion information for the curved area as detected via the imaging camera 600, and the compensation data therefor, and then the corrected image data of the curved area is displayed, thereby increasing the luminance distortion correction effect of the curved area and thus improving the image quality.

Further, the image data of the curved area is corrected such that the luminance of the curved area is not recognized in a distorted state and the stain is not displayed on the curved area, thereby improving the image data correction satisfaction and reliability of the curved area.

Although the aspects of the present disclosure have been described in more detail with reference to the accompanying drawings, the present disclosure is not necessarily limited to these aspects. The present disclosure may be implemented in various modified manners within the scope not departing from the technical idea of the present disclosure. Accordingly, the aspects disclosed in the present disclosure are not intended to limit the technical idea of the present disclosure, but to describe the present disclosure. the scope of the technical idea of the present disclosure is not limited by the aspects. Therefore, it should be understood that the aspects as described above are illustrative and non-limiting in all respects. The scope of protection of the present disclosure should be interpreted by the claims, and all technical ideas within the scope of the present disclosure should be interpreted as being included in the scope of the present disclosure.

What is claimed is:

1. A curved and flat combined display device comprising:

a display panel having a flat area and a curved area separated from each other, and including pixels arranged in the flat area and the curved area to display an image;

a compensation value generator configured to compare curved area data of an image data input from an external system with curved area data of imaged data generated by capturing the display panel, and generate compensation value data for the curved area of the display panel based on a comparing result; and a controller configured to compensate for the curved area data of the image data input from the external system based on the compensation value data, and control the display panel to display the compensated curved area data of the image data, wherein the compensation value generator correct the curved area data of the image data using the flat area data of the image data to calculate luminance compensation data for the curved area, wherein the compensation value generator correct the curved area data of the imaged data based on the flat area data of the imaged data to calculate stain compensation data for the curved area, and wherein the compensation value generator generate the compensation value data as a value obtained by dividing the stain compensation data by the luminance compensation data.

2. The device of claim 1, wherein the compensation value generator includes:

an image data processor configured to divide the image data input from the external system into the curved area data and flat area data during imaging inspection of the device;

a luminance compensation data generator configured to correct the curved area data based on the flat area data to calculate luminance compensation data for the curved area;

an imaged data processor configured to divide the imaged data captured by an imaging camera into the curved area data and flat area data; and a stain compensation data generator configured to correct the curved area data of the imaged data based on the flat area data of the imaged data to calculate stain compensation data for the curved area.

3. The device of claim 2, wherein the device further comprises:

a data processor configured to generate the compensation value data as a value obtained by dividing the stain compensation data by the luminance compensation data, and to transmit the compensation value data to the controller; and a compensator configured to generate compensated image data in which the curved area data is compensated for, wherein the compensated image data is obtained by adding or subtracting the compensation value data to or from the curved area data of the image data input from the external system, or by multiplying the curved area data of the image data input from the external system by the compensation value data.

4. The device of claim 2, wherein the luminance compensation data generator is configured to:

replace the curved area data of the image data with flat area data corresponding to at least one horizontal line adjacent to the curved area data to correct the curved area data of the image data; and compare a pixel-based gray level value or luminance value of the corrected curved area data with a pixel-based gray level value or luminance value of the curved area data from the image data processor, and calculate the luminance compensation data based on a difference value therebetween.

5. The device of claim 2, wherein the stain compensation data generator is configured to:

replace the curved area data of the imaged data with flat area data corresponding to at least one horizontal line adjacent to the curved area to correct the curved area data of the imaged data; and compare a pixel-based gray level value or luminance value of the corrected curved area data with a pixel-based gray level value or luminance value of the curved area data from the imaged data processor, and calculate the stain compensation data based on a difference value therebetween.

6. The device of claim 2, wherein the luminance compensation data generator is configured to replace the curved area data of the image data processor with flat area data corresponding to at least one block area adjacent to the curved area to correct the curved area data of the image data, and calculate the luminance compensation data.

7. The device of claim 2, wherein the stain compensation data generator is configured to replace the curved area data of the imaged data with flat area data corresponding to at least one block area adjacent to the curved area to correct the curved area data of the imaged data, and calculate the stain compensation data.

8. The device of claim 1, wherein the controller is configured to:

generate the compensated image data in which the curved area data is compensated for, wherein the compensated image data is obtained by adding or subtracting the compensation value data to or from the curved area data of the image data input from the external system, or by multiplying the curved area data of the image data input from the external system by the compensation value data; and control the display panel to display the compensated image data thereon.

9. A method for operating a curved and flat combined display device, wherein the device includes a display panel having a flat area and a curved area divided from each other, wherein the display panel includes pixels arranged in the flat area and the curved area to display an image, and wherein the method comprises:

dividing image data input from an external system into curved area data and flat area data;

calculating luminance compensation data from the curved area data of the image data;

dividing imaged data into curved area data and flat area data, wherein the imaged data is captured by an imaging camera;

calculating stain compensation data from the curved area data of the imaged data;

comparing the luminance compensation data with the stain compensation data and generating compensation value data for the curved area of the display panel, based on the comparing result;

compensating for the curved area data of the image data input from the external system based on the compensation value data; and controlling the display panel to display the compensated curved area data of the image data.

10. The method of claim 9, wherein the generating the compensation value data for the curved area of the display panel includes generating the compensation value data as a value obtained by dividing the stain compensation data by the luminance compensation data.

11. The method of claim 9, wherein the calculating the luminance compensation data includes:

replacing the curved area data of the image data with flat area data corresponding to at least one horizontal line adjacent to the curved area data to correct the curved area data of the image data; and comparing a pixel-based gray level value or luminance value of the corrected curved area data with a pixel-based gray level value or luminance value of the curved area data from the image data processor, and calculating the luminance compensation data based on a difference value therebetween.

12. The method of claim 9, wherein the calculating the stain compensation data includes:

replacing the curved area data of the imaged data with flat area data corresponding to at least one horizontal line adjacent to the curved area to correct the curved area data of the imaged data; and comparing a pixel-based gray level value or luminance value of the corrected curved area data with a pixel-based gray level value or luminance value of the curved area data from the imaged data processor, and calculating the stain compensation data based on a difference value therebetween.

13. The method of claim 9, wherein the calculating the luminance compensation data includes:

replacing the curved area data of the image data with flat area data corresponding to at least one block area adjacent to the curved area to correct the curved area data of the image data, and calculating the luminance compensation data.

14. The method of claim 9, wherein the calculating the stain compensation data includes replacing the curved area data of the imaged data with flat area data corresponding to at least one block area adjacent to the curved area to correct the curved area data of the imaged data, and calculating the stain compensation data.

15. A curved and flat combined display device comprising:

a display panel having a flat area and a curved area separated from each other;

a compensation value generator configured to compare curved area data of an image data input from an external system with curved area data of imaged data from the display panel, and generate compensation value data for the curved area of the display panel based on a comparing result, wherein the compensation value generator calculate stain compensation data from the curved area data of the imaged data;

a controller configured to compensate for the curved area data of the image data input from the external system based on the compensation value data, and control the display panel to display the compensated curved area data of the image data;

a data processor configured to generate the compensation value data as a value obtained by dividing the stain compensation data by the luminance compensation data, and to transmit the compensation value data to the controller; and a compensator configured to generate compensated image data in which the curved area data is compensated for.

16. The device of claim 15, wherein the compensated image data is obtained by adding or subtracting the compensation value data to or from the curved area data, or by multiplying the curved area data by the compensation value data.

17. The device of claim 15, wherein the compensation value generator includes:

an image data processor configured to divide the image data input from the external system into the curved area data and flat area data during imaging inspection of the device;

a luminance compensation data generator configured to correct the curved area data based on the flat area data to calculate luminance compensation data for the curved area;

an imaged data processor configured to divide the imaged data captured by an imaging camera into the curved area data and flat area data; and a stain compensation data generator configured to correct the curved area data of the imaged data based on the flat area data of the imaged data to calculate stain compensation data for the curved area.

18. The device of claim 17, wherein the luminance compensation data generator is configured to:

replace the curved area data of the image data with flat area data corresponding to at least one horizontal line adjacent to the curved area data to correct the curved area data of the image data; and compare a pixel-based gray level value or luminance value of the corrected curved area data with a pixel-based gray level value or luminance value of the curved area data from the image data processor, and calculate the luminance compensation data based on a difference value therebetween.

19. The device of claim 17, wherein the stain compensation data generator is configured to:

replace the curved area data of the imaged data with flat area data corresponding to at least one horizontal line adjacent to the curved area to correct the curved area data of the imaged data; and compare a pixel-based gray level value or luminance value of the corrected curved area data with a pixel-based gray level value or luminance value of the curved area data from the imaged data processor, and calculate the stain compensation data based on a difference value therebetween.

20. The device of claim 17, wherein the luminance compensation data generator is configured to replace the curved area data of the image data processor with flat area data corresponding to at least one block area adjacent to the curved area to correct the curved area data of the image data, and calculate the luminance compensation data.

* * * * *